US006437278B1

(12) United States Patent
Inoue et al.

(10) Patent No.: US 6,437,278 B1
(45) Date of Patent: Aug. 20, 2002

(54) GREEN COMPACT ELECTRODE FOR DISCHARGE SURFACE TREATMENT

(75) Inventors: Tooru Inoue; Akihiro Goto, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/548,433

(22) Filed: Apr. 12, 2000

Related U.S. Application Data

(63) Continuation of application No. PCT/JP98/01007, filed on Mar. 11, 1998.

(51) Int. Cl.[7] ..... B23H 1/04; B23H 1/06

(52) U.S. Cl. ..... 219/69.15; 219/69.11; 219/69.17

(58) Field of Search ..... 219/69.15, 69.11, 219/69.17, 118, 119, 146.21, 146.51; 76/4

(56) References Cited

U.S. PATENT DOCUMENTS 4,296,301 A * 10/1981 Johnson ..... 219/69 M
4,373,127 A * 2/1983 Haskett et al. ..... 219/69 E
5,804,789 A * 9/1998 Saito et al. ..... 219/69.17

FOREIGN PATENT DOCUMENTS

| | | |
|---|---|---|
| JP | 56-126535 | 10/1981 |
| JP | 60-2308 | 1/1985 |
| JP | 62-127448 | 6/1987 |
| JP | 1-92380 | 4/1989 |
| JP | 1-115522 | 5/1989 |
| JP | 1-178379 | 7/1989 |
| JP | 9-19829 | 1/1997 |
| JP | 9-192937 | 7/1997 |

* cited by examiner

*Primary Examiner*—M. Alexandra Elve
(74) *Attorney, Agent, or Firm*—Sughrue Mion, PLLC

(57) ABSTRACT

A green compact electrode for discharge surface treatment comprises a main body of green compact electrode obtained by pressuring and compacting metal powder or powder of a metal compound, or either of the two types of powder with ceramics powder added thereto; and a metallic die used for pressuring and compacting the main body of the green compact electrode, and is used for discharge surface treatment together with the die without taking out the main body of green compact electrode from the die.

23 Claims, 5 Drawing Sheets

GREEN COMPACT ELECTRODE FOR DISCHARGE SURFACE TREATMENT

This application is a continuation of International Application PCT/JP98/01007, with an international filing date of Mar. 11, 1998, which designated the United States, the entire contents of which are hereby incorporated by references.

TECHNOLOGICAL FIELD

The present invention relates to a green compact electrode for discharge surf ace treatment and more particularly, to a green compact electrode (discharge electrode) used for discharge surface treatment such as a formation of a hard coating on the surface of the work.

BACKGROUND TECHNOLOGY

Disclosed in Japanese Patent Laid-Open Publication No. 9-19829 is a method of discharge surface treatment that uses a green compact electrode in the presence of a treatment liquid such as discharge treatment oil, and uses a pulse discharge between a green compact electrode and a work to form a hard coating of the material of the electrode or of a substance such as metal carbide of TiC or so yielded through reaction of the electrode material on the work surface by the discharge energy.

Generally, the green compact electrode is prepared by making use of a property of the metal powder that the powder hardens when a powder of metal such as Ti is filled in a die and the metal powder in the die is pressured and compacted by a pressure punch.

The green compact electrode does not undergo sintering even when the metal powder is used, which is different from the electrode for discharge processing disclosed in Japanese Patent Laid-Open Publication No. 56-126535 and Japanese Patent Laid-Open Publication No. 62-127448, therefore, the electrode strength and the electric resistance finally achieved are decided depending on a state when its pressure and compacting are completed.

Therefore, in order to obtain a required final electrode strength and electric resistance, the green compact electrode requires the pressure of about 5 tonf/cm$^2$ as the compacting pressure. If the compacting pressure is lower than this, the strength of the compacted electrode may not be sufficient, or the electric resistance of the electrode may become extremely large, so that the electrode can not appropriately be used as a green compact electrode for discharge surface treatment.

On the other hand, when the electrode is compacted with such the large compacting pressure, the pressure on the metallic die is large and the metal powder in the metallic die expands in the lateral direction even if the compacting pressure is applied to the metal powder in the metallic die from the upper side (in the same direction as that to which the compacted material is taken out of the die), which makes the green compact electrode compacted in the die have power to laterally expand, and there is a tendency that it becomes difficult for such a green compact electrode to be taken out of the die.

Since a green compact electrode is singly used in the conventional type of discharge surface treatment, the green compact electrode needs to be taken out of the forming die during which the green compact electrode may be broken or chipped, because of which the manufacture yields of the green compact electrode are low.

The present invention has been made for solving the problems described above, and it is an object of the present invention to provide a green compact electrode for discharge surface treatment which can prevent any loss in the manufacturing steps and obtain high manufacture yields.

DISCLOSURE OF THE INVENTION

The present invention can provide a green compact electrode for discharge surface treatment used for discharge surface treatment for generating discharge between a work and a green compact electrode obtained by pressuring and compacting metal powder or powder of a metal compound, or either of the two types of powder with ceramics powder added thereto, and forming coatings consisting of an electrode material or a substance obtained through reaction of the electrode material with discharge energy on the work surface by the discharge energy; the electrode comprising a main body of green compact electrode obtained by pressuring and compacting metal powder or powder of a metal compound, or either of the two types of powder with ceramics powder added thereto; and a metallic die used for pressuring and compacting the main body of green compact electrode, and the electrode being used for discharge surface treatment together with the die without taking out the main body of green compact electrode from the die.

Accordingly, when using the main body of green compact electrode for discharge surface treatment there is no need to take out the main body of green compact electrode from the die, so that the main body of green compact electrode can be prevented from being chipped when it is taken out of the die.

The present invention can provide a green compact electrode for discharge surface treatment in which a forming chamber of the die has a structure of a through chamber penetrating the chamber in the direction from which a pressure punch is put into the chamber and taken out thereof.

Accordingly, when the die is to be reused, residue of the main body of green compact electrode can easily be removed from the forming chamber.

The present invention can provide a green compact electrode for discharge surface treatment in which a forming chamber of the die has a structure of a through chamber in a form constricted in the middle.

Accordingly, the main body of green compact electrode does not slip out of the forming chamber.

The present invention can provide a green compact electrode for discharge surface treatment in which a forming chamber of the die has a structure of a through chamber in a pot-shaped and tapered form.

Accordingly, the main body of green compact electrode does not slip out of the forming chamber, and residue of the main body of green compact electrode can easily be removed from the forming chamber by pushing it out from the rear side (side of the larger diameter) of the chamber.

The present invention can provide a green compact electrode for discharge surface treatment in which a plurality of forming chambers are provided on a single die, and the main body of green compact electrode is pressured and compacted in each of the forming chambers.

Accordingly, even when the main body of green compact electrode in one of the forming chambers is used completely, the main body of green compact electrode in another forming chamber can continuously be used.

The present invention can provide a green compact electrode for discharge surface treatment in which a die is used as an electrode holder, so that the electrode can be mounted on an electrode supporting section by holding the die.

Accordingly, the main body of green compact electrode in the electrode supporting section can be prevented from being chipped.

BEST MODE FOR CARRYING OUT THE INVENTION

Figure 1:
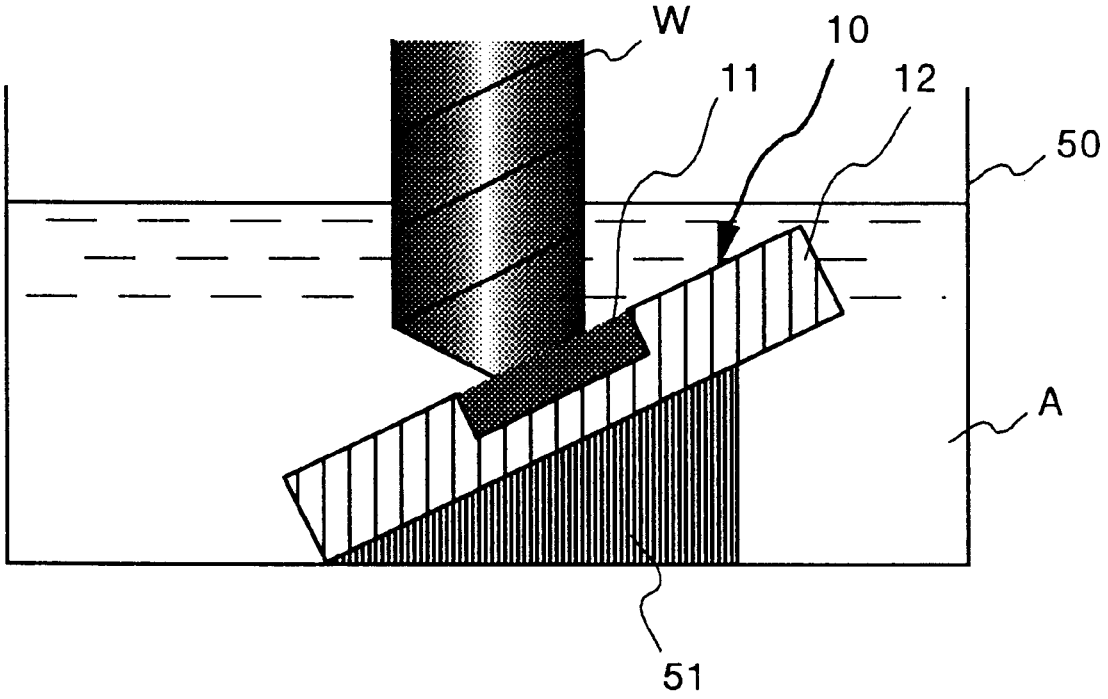
FIG. 1 is a view showing the green compact electrode for discharge surface treatment according to the present invention and a method for using the same, FIGS. 2 (*a*), (*b*) are cross-sectional views each showing construction of a metallic die used for manufacturing the green compact electrode for discharge surface treatment according to the present invention.

FIG. 1 shows the green compact electrode for discharge surface treatment according to the present invention and the method for using the same.

The green compact electrode for discharge surface treatment 10 comprises a main body of green compact electrode 11 obtained by pressuring and compacting metal powder or powder of a metal compound, or either of the two types of powder with ceramics powder added thereto; and a metallic die 12 used for pressuring and compacting the main body of green compact electrode 11.

The main body of green compact electrode 11 is used for discharge surface treatment without taking out of the die 12 so as to use the die 12 as if it is an electrode holder.

The green compact electrode for discharge surface treatment 10 is located in a treatment vessel 50 in a specified angular position by a support 51, the main body of green compact electrode 11 is positioned opposite to a drill electrode (work electrode) W to be subjected to discharge surface treatment with a specified discharging gap therebetween in the treatment liquid A filled in the treatment vessel 50, and hard coating consisting of a substance such as an electrode material for the main body of green compact electrode 11 or a metal carbide of TiC or the like yielded through reaction of the electrode material with discharge energy is formed on a blade surface of the drill electrode W by energy due to pulse discharge.

As described above, the main body of green compact electrode 11 obtained by pressuring and compacting in the die 12 is used together with the die 12 without taken out of the die 12, therefore, the main body of green compact electrode 11 is not possibly broken or chipped in the manufacturing steps, and manufacture yields of the green compact electrode for discharge surface treatment are high.

When the main body of green compact electrode 11 is consumed in the discharge surface treatment, the die 12 can be reused as a forming die by scraping off the residue of the main body of green compact electrode 11 from it.

Mounting the green compact electrode for discharge surface treatment 10 on the support (electrode supporting section) 51 can be carried out by holding the die 12 used as an electrode holder, therefore, as compared to a case in which the main body of green compact electrode 11 is directly mounted on the support 51 the chipping of the supporting section can be prevented.

Figure 2:
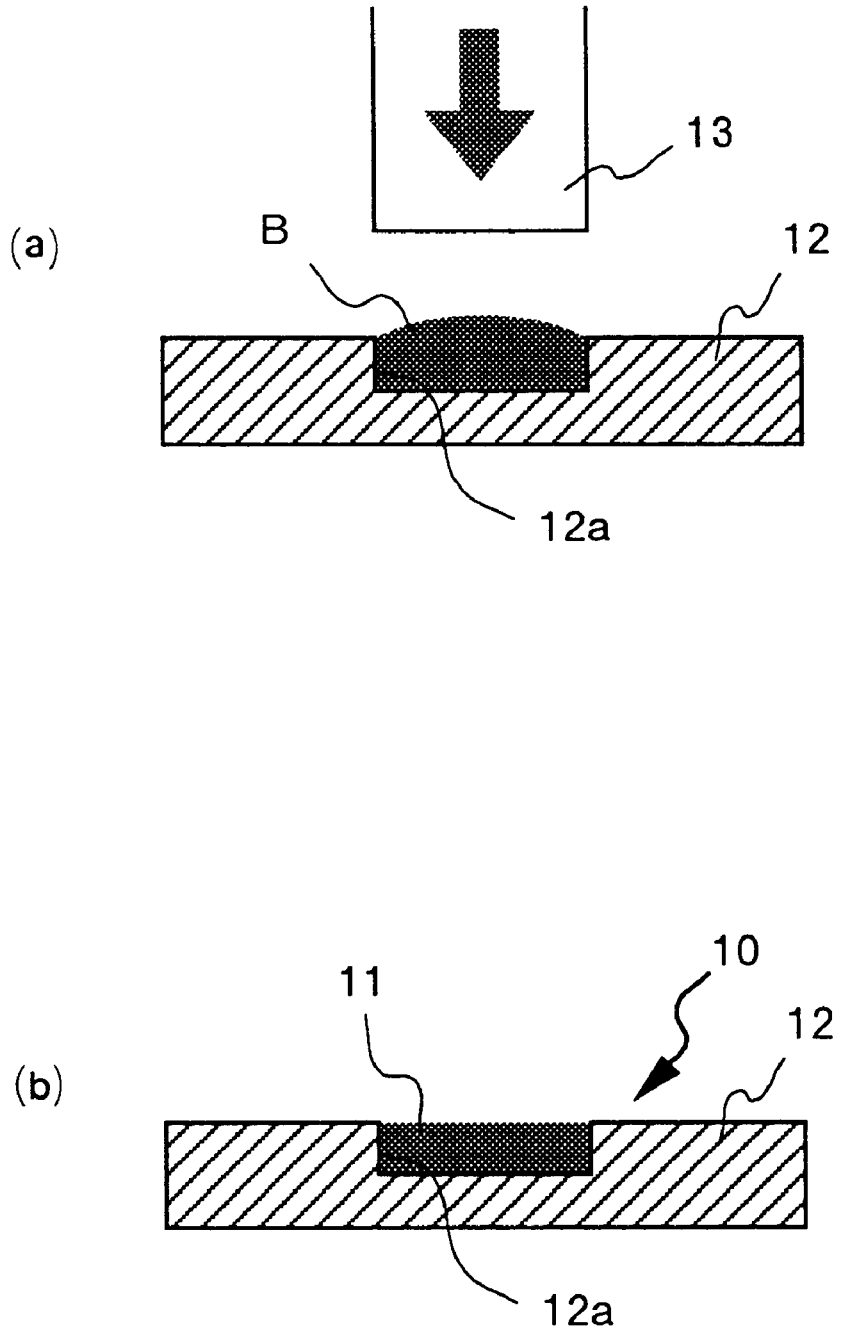

Pressure and compacting of the main body of green compact electrode 11 are performed in the same manner as to the conventional type as shown in FIG. 2 by using a die 12 and a pressure punch 13, filling a chamber 12*a* of the die 12 with metal powder or powder of a metal compound, or mixed powder B obtained by adding ceramics powder to either of the powder, and pressuring the powder by a pressure punch 13.

Figure 3:
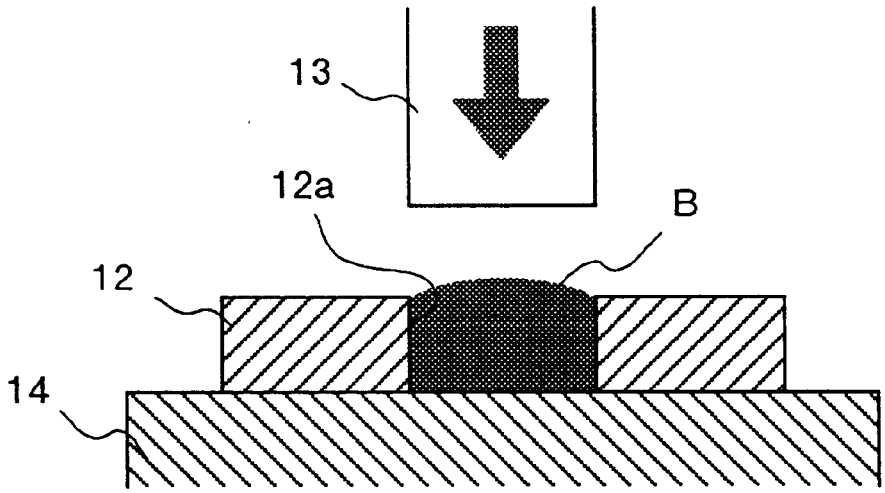
FIG. 3, FIG. 4, and FIG. 5 are cross-sectional views each showing another construction of a metallic die used for manufacturing the green compact electrode for discharge surface treatment according to the present invention.

The forming chamber 12*a* of the die 12 in this case may have a structure of a chamber with a bottom having the same length as the axial length of the main body of green compact electrode 11 as shown in FIG. 2, or the forming chamber 12*a* of the die 12 may have a structure of a through chamber penetrating the chamber in the direction to which the pressure punch 13 is put into the chamber and taken out thereof as shown in FIG. 3. When the forming chamber 12*a* of the die 12 has the structure of a through chamber, the die 12 is used for pressuring and compacting in a state where the die is placed on a detachably provided die plate 14.

When the forming chamber 12*a* of the die 12 has the structure of a through chamber, residue of the main body of green compact electrode 11 can easily be removed from the die after it is completely used by just pushing the residue out of the die.

Figure 4:
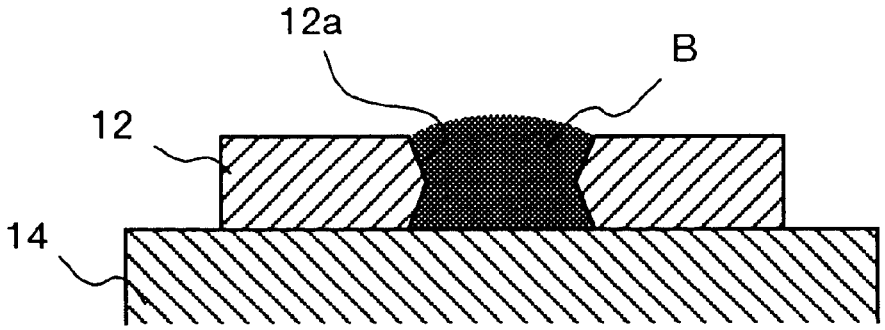
Figure 5:
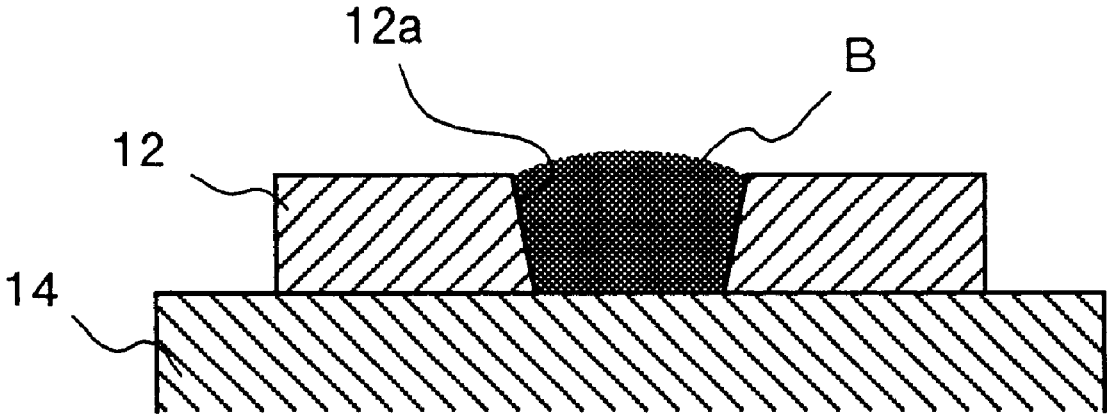

When the forming chamber 12*a* of the die 12 has the structure of a through chamber, the forming chamber 12*a* may have, in order to prevent the main body of green compact electrode 11 from being slipped out of the chamber, a form constricted in the middle (like a drum constricted in the middle) as shown in FIG. 4, or a pot-shaped and tapered form as shown in FIG. 5. If the forming chamber 12*a* of the die 12 is pot shaped and has a tapered form, residue of the main body of green compact electrode 11 can easily be removed from the die after it is completely used by just pushing the residue out from the rear side (the side of a larger diameter).

Figure 6:
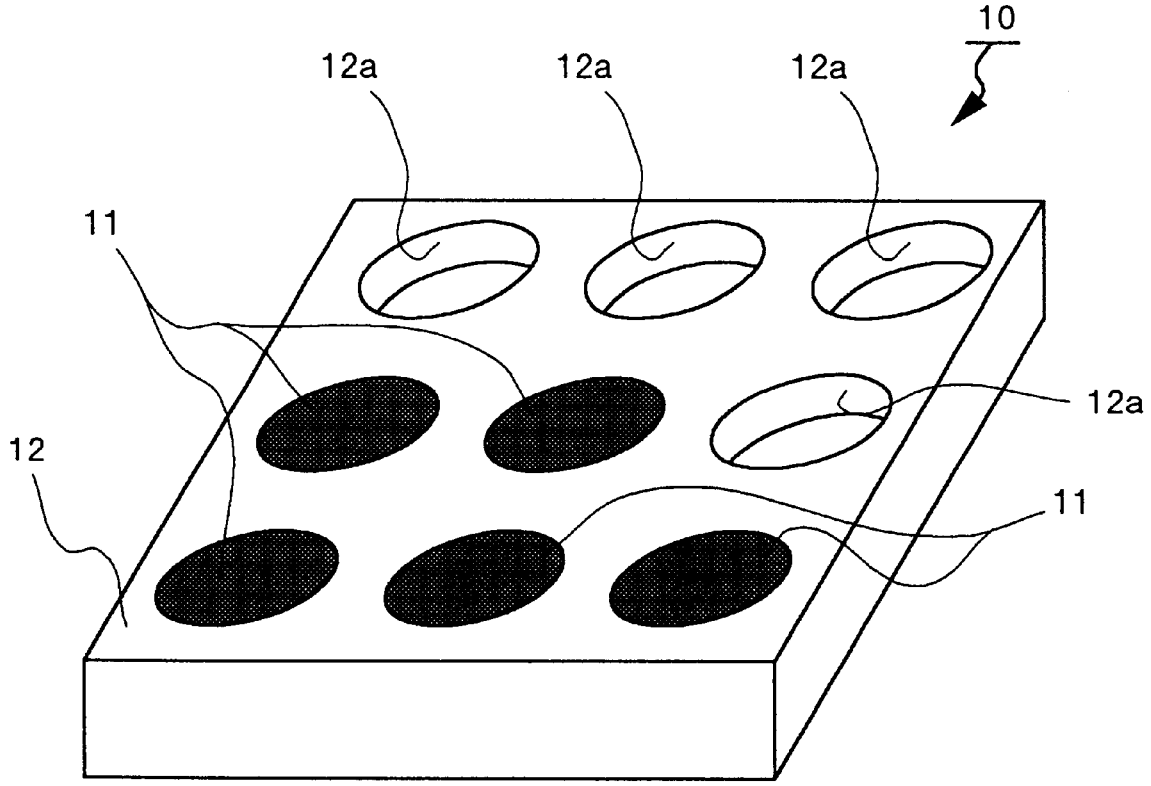
FIG. 6 is a perspective view showing another embodiment of the green compact electrode for discharge surface treatment according to the present invention.

As shown in FIG. 6, a plurality of forming chambers 12*a* may be provided on a signal die 12, and a main body of green compact electrode 11 may be pressured and compacted in each of the forming chambers 12*a*.

In this case, even when the main body of green compact electrode 11 in one of the forming chambers 12*a* is completely used, the main body of green compact electrode 11 in another forming chamber 12*a* can be used, therefore, a long and continuous operation can be performed without requiring an electrode replacement accompanied with die 12 replacement. Further, a number of required dies becomes smaller and the volume thereof can be reduced as compared to the case where only one main body of green compact electrode 11 is mounted on one unit of die 12.

INDUSTRIAL APPLICABILITY

The green compact electrode for discharge surface treatment according to the present invention is applicable to a discharge electrode used for discharge surface treatment to form a hard coating thereon.

What is claimed is:

1. A green compact electrode structure for electrical discharge surface treatment of a work, comprising; a green compact electrode body formed of a pressurized compact of at least a metal powder or a powder of a metal compound; and a metallic die in which said green compact electrode body is formed; wherein, during said electrical discharge surface treatment, said metallic die and said green compact electrode body in combination serve as said green compact electrode structure.

2. A green compact electrode structure according to claim 1; wherein a forming chamber of the die comprises a via penetrating the chamber in a compacting direction.

3. A green compact electrode structure according to claim 2; wherein the forming chamber of the die comprises a via having a constriction near a center thereof.

4. A green compact electrode structure according to claim 2; wherein the forming chamber of the die comprises a tapered via.

5. A green compact electrode structure according to claim 1; wherein a plurality of forming chambers are provided on a single die, and a green compact electrode is pressured and compacted in each of the forming chambers.

6. A green compact electrode structure according to claim 1; wherein said die comprises a holder for said green compact electrode, such that the electrode structure can be mounted on an electrode supporting section by holding said die.

7. A green compact electrode for discharge surface treatment of a work, comprising; a main body comprised of compacted and pressured metal powder or powder of a metal compound, and a metal die comprising a forming chamber for the main body, wherein the main body remains in the die during said surface treatment of the work.

8. A green compact electrode structure described in claim 7, wherein said main body further comprises a ceramic powder.

9. A green compact electrode structure described in claim 7, wherein the forming chamber of the die comprises a via penetrating the chamber in a compacting direction.

10. A green compact electrode structure described in claim 7, wherein the forming chamber of the die comprises a via having a constriction near a center thereof.

11. A green compact electrode structure described in claim 7, wherein the forming chamber of the die comprises a tapered via.

12. A green compact electrode structure described in claim 7, wherein the die comprises a plurality of said forming chambers.

13. A process for producing and using a green compact electrode, comprising; pressuring and compacting a metal powder or powder of a metal compound in a metal die, and performing electrical discharge surface treatment of a work, using said green compact electrode, while said green compact electrode remains in said metal die.

14. A process described in claim 13, wherein a main body of the green compact electrode further comprises a ceramic powder.

15. A process described in claim 13, wherein a forming chamber of the die comprises a via penetrating the chamber in a compacting direction.

16. A process described in claim 13, wherein a forming chamber of the die comprises a via having a constriction near a center thereof.

17. A process described in claim 13, wherein a forming chamber of the die comprises a tapered via.

18. A process described in claim 13, wherein the die comprises a plurality of forming chambers.

19. A method for discharge surface treating a work using an electrical discharge machine, comprising; positioning an electrode, comprised of a green compact held in a metallic die in which it was formed, opposite a work; and forming a coating on the work by causing electrical discharge between the green compact and the work.

20. A method described in claim 19, wherein the coating is comprised of at least one material from said electrode.

21. A method described in claim 20, wherein the coating is a substance obtained from reacting electrode material with at least one of a work material and a dielectric.

22. A method described in claim 20, wherein the green electrode comprises pressured and compacted metal powder or a powder of a metal compound.

23. A method of surface treating a work, comprising providing a green compact electrode by compacting at least a metallic powder or a powder of a metallic compound into a metallic die under pressure; and conducting electrical discharge between said green compact electrode and the work while said green compact electrode is held by said die.

* * * * *